US008601642B2

(12) United States Patent
Son et al.

(10) Patent No.: US 8,601,642 B2
(45) Date of Patent: Dec. 10, 2013

(54) VACUUM CLEANER

(75) Inventors: Youngbok Son, Changwon-shi (KR); Jinhyouk Shin, Busan (KR); Sang-Hun Bae, Changwon-shi (KR); Sung-Hwa Lee, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 1999 days.

(21) Appl. No.: 10/579,735

(22) PCT Filed: Aug. 19, 2005

(86) PCT No.: PCT/KR2005/002758
§ 371 (c)(1),
(2), (4) Date: May 18, 2006

(87) PCT Pub. No.: WO2007/021048
PCT Pub. Date: Feb. 22, 2007

(65) Prior Publication Data

US 2009/0100637 A1 Apr. 23, 2009

(51) Int. Cl.
*A47L 5/00* (2006.01)

(52) U.S. Cl.
USPC ..... 15/375

(58) Field of Classification Search
USPC ..... 15/375, 384, 372, 392, 320, 322, 353, 15/401, 245, 321
See application file for complete search history.

(56) References Cited

U.S. PATENT DOCUMENTS

| | | | | |
|---|---|---|---|---|
| 4,426,751 | A * | 1/1984 | Nordeen | 15/384 |
| 4,817,233 | A * | 4/1989 | Waldhauser | 15/320 |
| 5,394,588 | A * | 3/1995 | Kweon et al. | 15/372 |
| 5,867,861 | A * | 2/1999 | Kasen et al. | 15/320 |
| 2003/0145425 | A1* | 8/2003 | Fernandez-Grandizo Martinez | 15/393 |

FOREIGN PATENT DOCUMENTS

| | | |
|---|---|---|
| DE | 19502867 | 1/1996 |
| KR | 2000-0017205 | 9/2000 |

OTHER PUBLICATIONS

Korean Office Action dated May 28, 2009.

* cited by examiner

*Primary Examiner* — Robert Scruggs
(74) *Attorney, Agent, or Firm* — Ked & Associates, LLP

(57) ABSTRACT

A vacuum cleaner is provided which can remove substances from a surface by a rotary force of a brush and a vacuum pressure operated on a suction head on which the brush is rotatably installed. The vacuum cleaner improves a user's convenience by preventing thin and long substances, such as hair or the fur of a pet dog, from being wound around the brush. The vacuum cleaner may include a suction head installed at a front end of a suction path, that sucks substances by a vacuum pressure generated by a suction motor and having a suction hole for sucking the substances, a brush installed in the suction hole and rotated to contact a surface, and a hair tunnel formed on the suction head so as not to interfere with the brush, that preferentially sucks thin and long substances from the surface.

11 Claims, 7 Drawing Sheets

VACUUM CLEANER

TECHNICAL FIELD

The present invention relates to a vacuum cleaner which can remove substances from the bottom by a rotary force of a brush and a vacuum pressure operated on a suction head by rotatably installing the brush on the suction head, and more particularly to, a vacuum cleaner which can consult a user's convenience by preferentially sucking thin and long substances such as hairs or furs of a pet dog not to be wound around the brush.

BACKGROUND ART

In general, a vacuum cleaner generates a suction force by a vacuum pressure, sucks the air and substances from the bottom, separates the air from the sucked substances, filters fine alien substances of the sucked air through various filters, and discharges the air.

The vacuum cleaners are classified into a cylindrical floor type vacuum cleaner, an upright type vacuum cleaner and a hand type vacuum cleaner by uses and using methods. The floor type vacuum cleaner can efficiently clean a hard bottom such as a wooden floor generally in a house, the upright type vacuum cleaner can efficiently clean a carpet, and the hand type vacuum cleaner can efficiently clean a narrow space such as stairs and desks.

The floor type or upright type vacuum cleaner includes a main body for generating a suction force, separating substances on a suction path, and filtering off fine alien substances of the sucked air such as dust, and a suction head or a suction nozzle unit linked to the main body, for contacting the bottom and sucking the substances and the ambient air.

In detail, the main body houses a suction motor for generating a suction force in a main body casing in which a suction path for the sucked air has been formed, and includes a filter assembly disposed higher than the suction motor in the sucked air flow direction, for filtering off fine alien substances of the suction flow such as dust.

Here, a suction tube linked to the suction head is connected to the lower region of the main body casing, and an exhaust unit having a plurality of holes for discharging the air passing through the suction motor and the filter assembly is formed at the rear upper region of the main body casing.

As shown in FIG. 1, the suction head is installed at the lower portion of the main body casing to be linked to the main body casing. A suction casing 2 having a suction hole 2*h* on its rectangular bottom surface for the inflow of the sucked air is installed to be linked to the suction tube I of the main body casing. A brush 4 adhered to an agitator is rotated on the suction hole 2*h* of the suction casing 2, for pressurizing and agitating the inside of the carpet by the rotary force, floating dust hidden deep in the carpet, and sucking the substances from the bottom by a suction force by a vacuum pressure generated in the main body. If necessary, a plurality of bristles can be protruded from the brush 4 to easily clean the carpet. The structure of FIG. 1 is one example of the upright vacuum cleaner. However, the floor type vacuum cleaner can have the same structure. That is, the agitator and the brush can be installed on the suction head, for pressurizing the bottom to facilitate suction of substances from the bottom.

Here, the brush 4 is positioned to cross the suction hole 2*h* of the suction casing 2 with its both ends hinge-coupled. One end of the brush 4 is connected to a driving motor (not shown) by various pulleys (not shown), so that the brush 4 can be rotatably driven.

Accordingly, when the suction motor is operated, the suction force is generated by the vacuum pressure, and thus the substances and the ambient air are sucked from the bottom through the suction hole 2*h* of the suction head. Here, when the driving motor is operated, the brush 4 is rotated to pressurize and agitate the bottom. The substances hidden deep in the carpet are floated or the substances adhered to the bottom are easily separated from the bottom, and sucked through the suction hole 2*h* with the sucked air.

The sucked air including the sucked substances flows through the suction tube I and the suction path and is separated from the substances. When the sucked air passes through the filter assembly, the fine alien substances of the sucked air such as dust are filtered off. Then, the air is discharged through the exhaust unit.

However, thin and long substances such as hair or fur of a pet dog exist on the bottom. In the conventional vacuum cleaner installing the brush on the agitator to improve cleaning efficiency, the thin and long substances are sucked through the suction hole by the vacuum pressure of the suction motor, transferred along the suction path, and wound around the rotating brush, instead of being separated from the sucked air with the other substances in the main body. The thin and long substances wound around the brush are not good for sanitation and appearance. Also, the thin and long substances reduce cleaning efficiency by deteriorating the function of the brush. Furthermore, it is difficult for the user to remove the thin and long substances wound around the brush.

DISCLOSURE OF THE INVENTION

The present invention is achieved to solve the above problems. An object of the present invention is to provide a vacuum cleaner which can make a brush clean and maintain performance of the brush, by sucking thin and long substances from the bottom before being wound around the brush, sending the substances to a suction path, and separating the substances with the other substances in a main body, when the brush for pressurizing and agitating the bottom by a rotary force is rotatably installed on a suction head for sucking the air including substances.

In order to achieve the above-described object of the invention, there is provided a vacuum cleaner, including: a suction head being installed at a front end of a suction path for sucking substances by a vacuum pressure generated by a suction motor, and having a suction hole for sucking the substances on its bottom; a brush installed on the suction hole of the suction head, and rotated to contact the bottom; and a hair tunnel formed on the suction head not to interfere with the brush, for preferentially sucking thin and long substances from the bottom.

The hair tunnel is linked to the front end of the suction path through a path isolated from the path for linking the suction hole to the front end of the suction path in the suction head. The inlet unit of the hair tunnel is installed to surround the suction hole, or installed at the front and/or rear portion of the suction hole in the general suction head progress direction.

A sweeper is installed at the inlet unit of the hair tunnel, for preferentially sucking the thin and long substances from the bottom to the hair tunnel. The sweeper includes a first sweeper partially downwardly protruded from the bottom surface of the end of the inlet unit of the hair tunnel far from the suction hole, and a second sweeper downwardly protruded from the bottom surface of the end of the inlet unit of the hair tunnel close to the suction hole.

In detail, the first and second sweepers are formed in a group bristle shape or comb-tooth shape with a predetermined width. The interval of the comb teeth of the second sweeper is smaller than that of the comb teeth of the first sweeper. The first and second sweepers can sweep the thin and long substances such as hairs or furs of a pet dog twice.

The comb teeth of the first sweeper are longer than those of the second sweeper to reduce a friction force with the bottom. Some of the comb teeth of the first sweeper include a support member for reducing an operation resistance by the first sweeper and obtaining a flow space of the sucked air.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION

The preferred embodiments of the present invention achieving the above object will now be described in detail with reference to the accompanying drawings.

The preferred embodiments of the present invention will now be explained by exemplifying an upright vacuum cleaner. However, the scope of the present invention should not be limited to these preferred embodiments but to the claims as hereinafter recited. Especially, the present invention can be applied to different types of vacuum cleaners including the structure of the claims, such as floor type and hand type vacuum cleaners.

Figure 1:
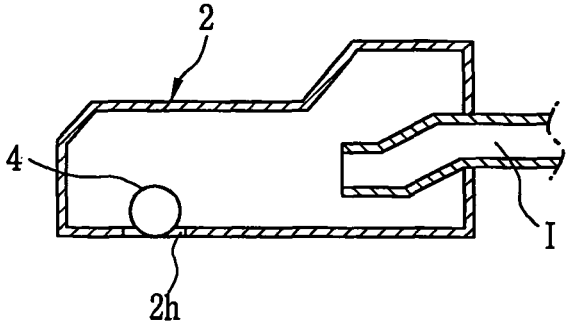
FIG. 1 is a side-sectional view illustrating a suction head of a conventional upright vacuum cleaner.
Figure 2:
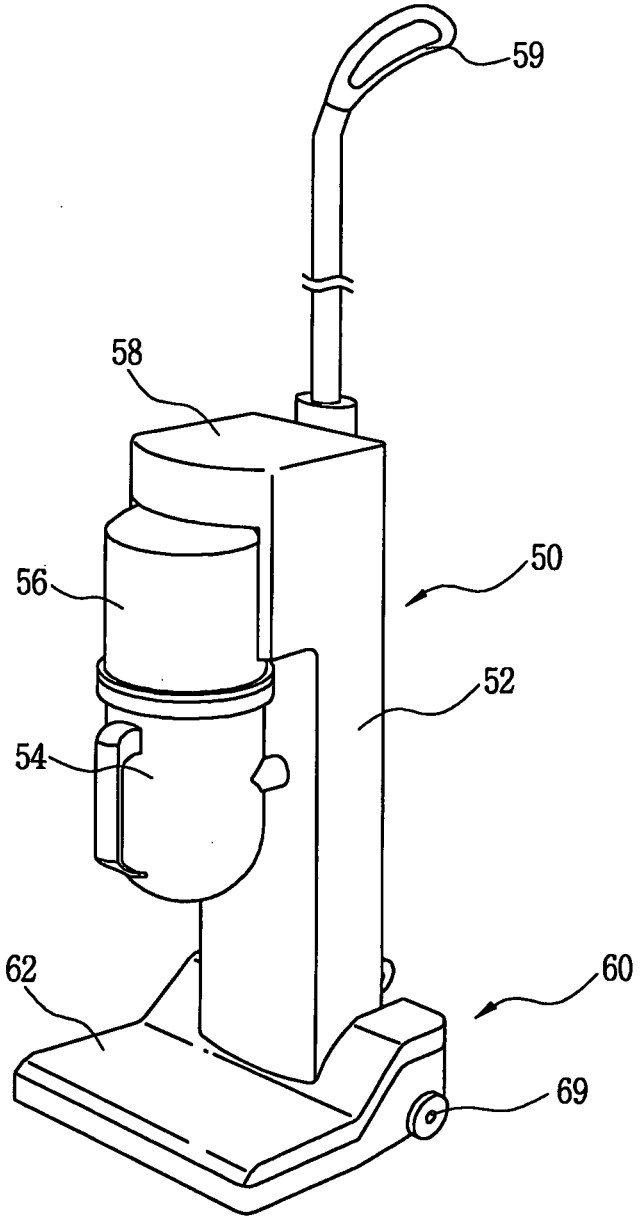
FIG. 2 is a perspective view illustrating an upright vacuum cleaner in accordance with the present invention.

Referring to FIG. 2, the upright vacuum cleaner includes a main body 50 for generating a suction force and separating substances from sucked air, and a suction head 60 linked to the main body 50, for sucking the sucked air. The suction head 60 is installed to individually suck thin and long substances such as hair or fur of a pet dog from the sucked air.

The main body 50 includes a main body casing 52 having a suction path inside, a filter assembly 54 installed on the suction path of the main body casing 52, for filtering off substances of the sucked air such as dust, and a suction motor 56 installed on the suction path of the main body casing 52 at the rear end of the filter assembly 54, for generating a suction force.

A suction tube I is installed at the lower region of the main body casing 52 to be connected to the suction path and linked to the suction head 60. An exhaust unit 58 having a plurality of slit holes is formed at the rear upper region of the main body casing 52, for discharging the air passing through the filter assembly 54.

A handle 59 is upwardly extended from the higher region than the exhaust unit 58 in the main body casing 52, and a control unit (not shown) for controlling the operation of the suction motor 56 is formed at one side of the main body casing 52.

The suction motor 56 is formed in a cylindrical shape. When power is applied to the suction motor 56, the fan is rotated to generate the suction force by the air pressure difference. The filter assembly 54 is detachably installed in the suction area, and the exhaust unit 58 of the main body casing 52 is linked to the discharge area.

Here, the filter assembly 54 includes various filter members for filtering off the substances of the air sucked to the suction motor 56, such as dust hair and fur of a pet dog, or a dust collecting vessel for collecting the substances of the air in a cyclone method.

Figure 3:
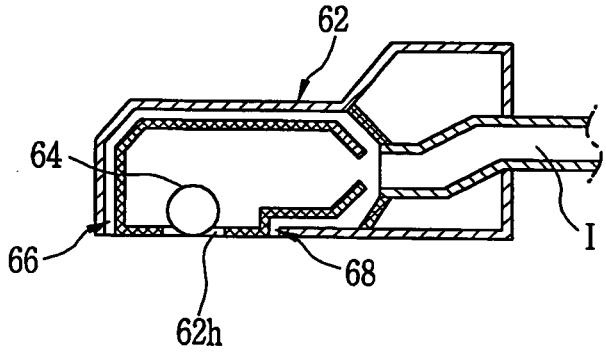
FIGS. 3 and 4 are a side-sectional view and a rear view illustrating a suction head of the upright vacuum cleaner of FIG. 2.
Figure 4:
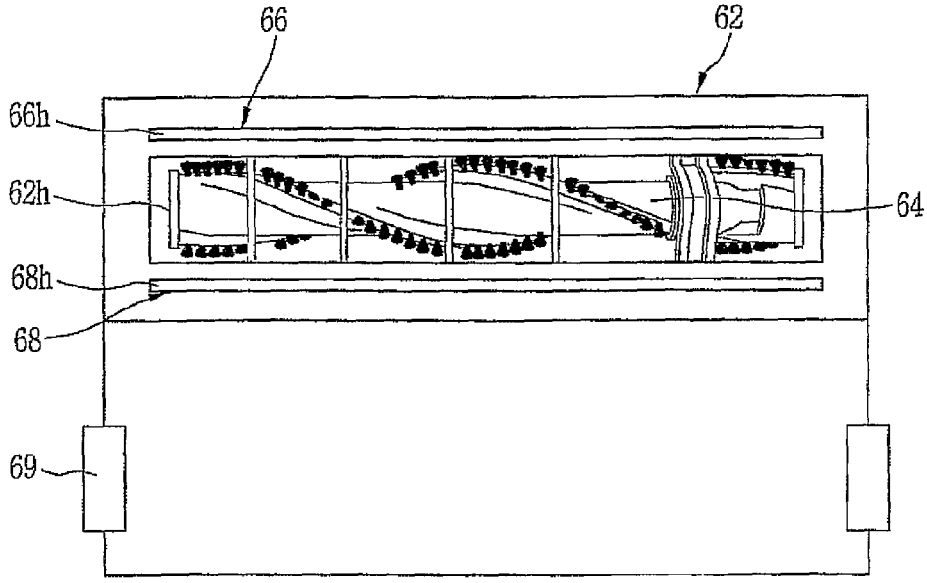

On the other hand, as illustrated in FIGS. 3 and 4, in the suction head 60, a suction casing 62 is hinge-coupled to the lower portion of the main body casing 52, a brush 64 is rotatably installed on a suction hole 62*h* formed on the bottom surface of the suction casing 62, and a pair of hair tunnels 66 and 68 are formed on the suction hole 62*h* at both sides of the progress direction of the suction head 60. The hair tunnels 66 and 68 are linked to the suction tube I of the main body casing 52, for sucking the thin and long substances such as hair or fur of a pet dog individually from the suction hole 62*h*.

The suction casing 62 has its top end linked to the suction tube I of the main body casing 52, and is hinge-coupled to be freely moved. The rectangular suction hole 62*h* is formed long in the width direction on the bottom surface of the suction casing 62. A suction path (not shown) is formed in the suction hole 62*h*, for guiding the sucked air to the suction tube I of the main body casing 52.

The brush 64 is positioned to cross the suction hole 62*h* with its both ends hinge-coupled. One end of the brush 64 is connected to a driving motor (not shown) by various pulleys (not shown) and rotatably driven.

Here, the brush 64 is formed in a cylindrical shape. Spiral bristles are protruded from the surface of the brush 64. When the suction hole 62*h* is adhered to the bottom, the brush 64 pressurizes the bottom, facilitates suction of the substances hidden in the bottom such as dust, and generates a suction force.

Especially, the hair tunnels 66 and 68 are isolated from the path for linking the suction hole 62*h* to the front end of the suction tube I, and linked to the front end of the suction tube I of the main body casing 52 in the suction casing 62, for generating the suction force inside. The inlet units 66*h* and 68*h* of the hair tunnels 66 and 68 are much smaller than the suction hole 62*h*, for individually sucking the thin and long substances.

In detail, as shown in FIG. 4, when seen in the progress direction of the suction holes 62*h*, the hair tunnels 66 and 68 can be two hair tunnels 66 and 68 having their inlet units 66*h* and 68*h* formed at the front and rear portions of the suction hole 62*h*. Preferably, the inlet units 66*h* and 68*h* are formed in a slot hole shape long in the width direction at predetermined intervals from the suction hole 62*h*.

It is also possible to form only one of the front hair tunnel 66 having its inlet unit 66*h* formed at the front portion of the suction hole 62*h* and the rear hair tunnel 68 having its inlet unit 68*h* formed at the rear portion of the suction hole 62*h*.

Accordingly, when the suction head 60 moves forward to clean the bottom, the thin and long substances are sucked through the front hair tunnel 66, and the other large substances are sucked through the suction hole 62*h*. Conversely, when the suction head 60 moves backward to clean the bottom, the thin and long substances are sucked through the rear hair tunnel 68, and the other large substances are sucked through the suction hole 62*h*.

Although the substances are individually sucked through the hair tunnels 66 and 68 and the suction hole 62*h*, the substances are collected at the front end of the suction tube I of the main body casing 52, transferred through the suction tube I and the suction path of the main body casing 52, and filtered off.

Figure 5:
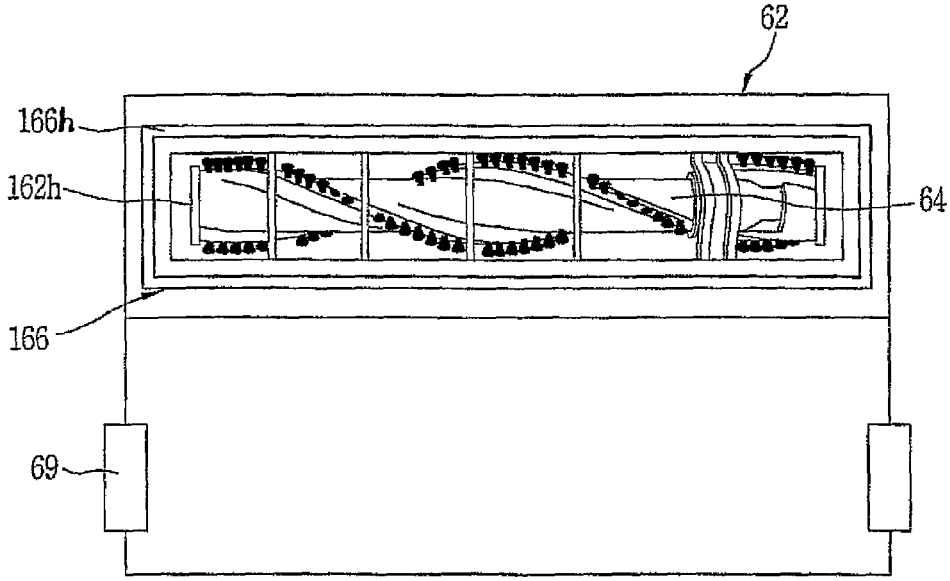
FIG. 5 is a rear view illustrating another example of the suction head that can be applied to the upright vacuum cleaner of FIG. 2.

On the other hand, as shown in FIG. 5, the inlet unit 166*h* of the hair tunnel 166 can be formed to surround the suction hole 162*h*. Preferably, the inlet unit 166*h* is formed in a polygonal ring shape with a predetermined interval from the circumference of the suction hole 162*h*.

Therefore, when the suction head 60 moves in any one of the forward and backward and side directions to clean a surface, the thin and long substances are sucked through the hair tunnel 166, and the other large substances are sucked through the suction hole 162*h*. Such substances are transferred through the suction tube I and the suction path, and filtered off.

As described above, the thin and long substances, such as hair or fur of a pet dog, are sucked through the hair tunnels 66, 68 and 166 and the other substances are sucked through the suction hole 162*h*. Even if the thin and long substances pass through the brush 64, they are not wound around the brush 64. As a result, the user does not have to clean the brush 64. The appearance of the vacuum cleaner can also be improved. Because the substances are sucked through the hair tunnels 66, 68 and 166 and the suction hole 162*h* at the same time, the cleaning area can be widened and suction efficiency can be improved.

Figure 6:
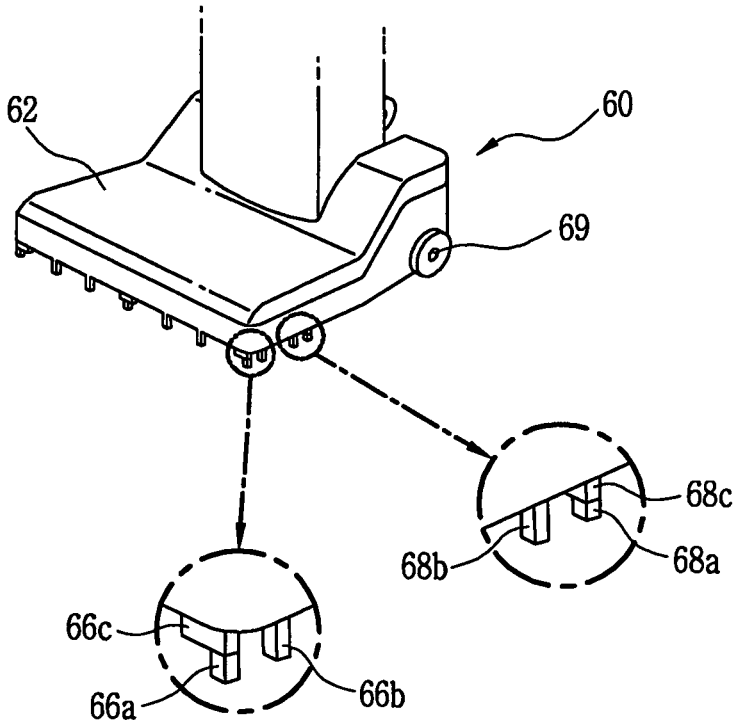
FIGS. 6 and 7 are a perspective view and a side-sectional view illustrating first and second sweepers applied to hair tunnels of the upright vacuum cleaner of FIG. 2.
Figure 7:
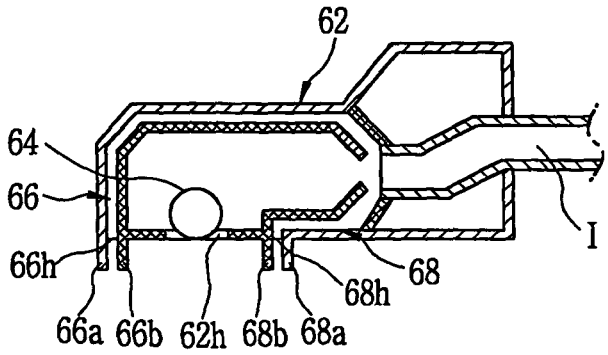

On the other hand, referring to FIGS. 6, and 7, the suction head 60 of the vacuum cleaner includes first and second sweepers 66*a*, 66*b*, 68*a* and 68*b* at the front and rear ends of each hair tunnel 66 and 68. The first and second sweepers 66*a*, 66*b*, 68*a* and 68*b* of the hair tunnels 66 and 68 are more protruded than the bottom surface of the suction casing 62 on which the inlet units 66*h* and 68*h* of the hair tunnels 66 and 68 have been formed. When the suction casing 62 moves closely to the bottom such as a carpet C, the first and second sweepers 66*a*, 66*b*, 68*a* and 68*b* are inserted into the bottom and transferred. Therefore, the thin and long substances hidden in the bottom are hooked on the first and second sweepers 66*a*, 6*b*, 68*a* and 68*b*. The thin and long substances hooked on the first and second sweepers 66*a*, 66*b*, 68*a* and 68*b* are efficiently sucked through the adjacent inlet units 66*h* and 68*h* of the hair tunnels 66 and 68 by the suction force generated by the hair tunnels 66 and 68.

The first and second sweepers 66*a*, 66*b*, 68*a* and 68*b* are downwardly protruded from the progress direction and the opposite direction of the hair tunnels 66 and 68, respectively. In detail, the first and second sweepers 66*a* and 66*b* are formed at the front and rear ends of the front hair tunnel 66, and the first and second sweepers 68*a* and 68*b* are formed at the rear and front ends of the rear hair tunnel 68.

Figure 8A:
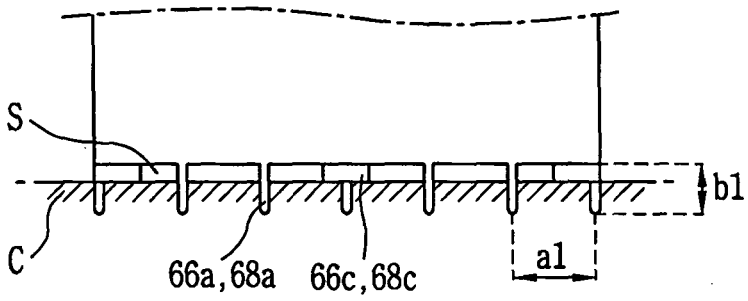
FIGS. 8A and 8B are front views illustrating examples of the first and second sweepers of FIG. 6.
Figure 8B:
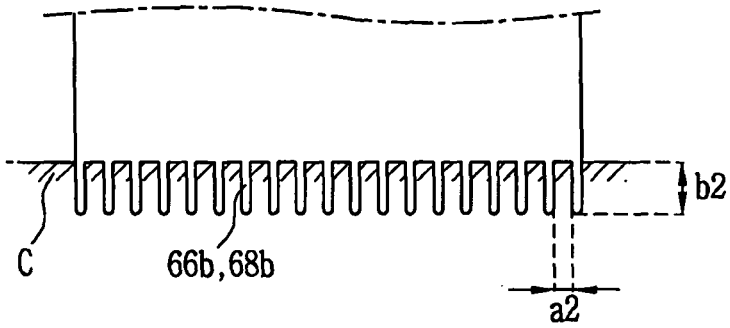

In addition, the first and second sweepers 66*a*, 66*b*, 68*a* and 68*b* can be irregularly downwardly protruded from the front and rear ends of the hair tunnels 66 and 68, or formed in a group bristle shape or a comb shape having teeth at regular intervals. The first and second sweepers 66*a*, 66*b*, 68*a* and 68*b* will now be explained in more detail with reference to FIGS. 8A and 8B. The interval a1 between the comb teeth of the first sweepers 66*a* and 68*a* is relatively larger than the interval a2 between the comb teeth of the second sweepers 66*b* and 68*b*.

Accordingly, when the suction head 60 moves forward or backward to clean the bottom, the thin and long substances hidden in the bottom are firstly hooked on the relatively sparse comb teeth of the first sweepers 66*a* and 68*a*, and the other thin and long substances are secondly hooked on the relatively dense comb teeth of the second sweepers 66*b* and 68*b*. Because the thin and long substances are filtered off by the comb teeth of the first and second sweepers 66*a*, 66*b*, 68*a* and 68*b* twice and. sent to the adjacent hair tunnels 66 and 68, the thin and long substances are not wound around the brush 64 through the suction hole 62*h*.

In the case that the comb teeth of the first and second sweepers 66*a*, 66*b*, 68*a* and 68*b* are more densely formed, the friction force to the bottom increases. Accordingly, a large force is required to move the suction head 60, and the air is not efficiently sucked between the comb teeth of the first and second sweepers 66*a*, 66*b*, 68*a* and 68*b*, which reduces cleaning performance. In order to solve the foregoing problems, the length b1 of the comb teeth of the first sweepers 66*a* and 68*a* is more lengthened than the length b2 of the comb teeth of the second sweepers 66*b* and 68*b*, and space obtaining support members 66*c* and 68*c* are downwardly protruded with a length shorter than the length of the first sweepers 66*a* and 68*a* between the first sweepers 66*a* and 68*a* and the hair tunnels 66 and 68. The space obtaining support members 66*c* and 68*c* can be formed on some of the comb teeth of the first sweepers 66*a* and 68*a*.

Because the ends of the comb teeth of the first sweepers 66*a* and 68*a* are inserted into the bottom such as the carpet C and the space obtaining support members 66*c* and 68*c* are supported on the bottom, the friction force decreases between the first sweepers 66*a* and 68*a* and the bottom. Thus, the suction head 60 can be easily transferred, and the suction flow can be increased by forming a suction space S for sucking the sucked air between the first sweepers 66*a* and 68*a* and the bottom, thereby improving cleaning performance.

The operation of the upright vacuum cleaner in accordance with the present invention will now be described.

When the suction head 60 moves forward to clean the bottom, if the suction hole 62*h* of the suction casing 62 is transferred closely to the bottom such as the carpet C, the first and second sweepers 66*a*, 66*a*, 68*a* and 68*b* are inserted into the bottom and transferred to hook the thin and long substances such as hair and a fur of a pet dog. The brush 64 is also transferred to pressurize the bottom.

Here, when the suction motor 56 is operated, the suction force is generated in the suction hole 62*h* and the hair tunnels 66 and 68. Various substances hooked on the first sweeper 66*a* are sucked through the front hair tunnel 66, and the other substances are hooked on the second sweeper 66*b* having denser comb teeth than the first sweeper 66*a* and sucked through the front hair tunnel 66. Some substances are guided by the first and second sweepers 68*a* and 68*b* and sucked through the rear hair tunnel 68.

In addition, the brush 64 is rotated to pressurize the bottom, and thus the substances hidden in the bottom such as dust are efficiently sucked through the suction hole 62*h*.

Even if the ends of the comb teeth of the first sweepers 66*a* and 68*a* are inserted into the carpet C, since the space obtaining support members 66*c* and 68*c* are supported on the bottom, the sucked air is sucked to the suction space S and sucked through the front and rear hair tunnels 66 and 68 and the suction hole 62*h*. That is, the suction area is relatively widened to improve cleaning performance. Because most of the thin and long substances are sucked through the front hair tunnel 66, the other substances are sucked through the suction hole 62*h*. It is thus possible to prevent the thin and long substances from being wound around the brush 64.

As described above, various substances sucked through the front and rear hair tunnels 66 and 68 and the suction hole 62*h* are transferred through the suction tube I and the suction path of the main body casing 52, filtered off through the dust collecting vessel and/or the filter assembly 54, and externally discharged through the exhaust unit 58 via the suction motor 56.

On the other hand, when the suction head 60 moves backward to clean the bottom by operating the suction motor 56, various thin and long substances are guided by the first and second sweepers 68*a* and 68*b* in the rear hair tunnel 68 and filtered off in the same manner.

What is claimed is:

1. A vacuum cleaner, comprising:

a suction head installed at a front end of a suction path, wherein a vacuum pressure generated by a suction motor draws substances in through a suction hole formed in a bottom surface of an outer casing of the suction head and into the suction path;

a brush rotatably installed in the suction hole of the suction head, and configured to rotatably contact a surface to be cleaned; and at least one hair tunnel formed in the suction head, wherein an inlet into the at least one hair tunnel and an inlet into the suction hole are spaced apart from each other on the bottom surface of the outer casing with a corresponding portion of the bottom surface of the outer casing positioned therebetween such that the brush installed in the suction hole does not interfere with the at least one hair tunnel, wherein the at least one hair tunnel draws thin and long substances from the surface.

2. The vacuum cleaner of claim 1, wherein the at least one hair tunnel is linked to the front end of the suction path by a first path that is isolated from a second path that links the suction hole to the front end of the suction path.

3. The vacuum cleaner of claim 2, wherein the inlet of the at least one hair tunnel surrounds the suction hole, with the corresponding portion of the outer casing of the suction head positioned therebetween.

4. The vacuum cleaner of claim 2, wherein the inlet of the at least one hair tunnel is positioned at one of a front portion or a rear portion of the suction hole in a direction corresponding to a movement direction of the suction head.

5. The vacuum cleaner of claim 1, further comprising at least one sweeper provided at the inlet of the at least one hair tunnel, wherein the at least one sweeper extends downward from the bottom surface of the outer casing at a peripheral edge portion of the inlet of the at least one hair tunnel.

6. The vacuum cleaner of claim 5, wherein the at least one sweeper comprises a first sweeper that protrudes downward from the bottom surface of the outer casing along a first peripheral edge of the inlet of the at least one hair tunnel, and a second sweeper that protrudes downward from the bottom surface of the outer casing along a second peripheral edge of the inlet of the at least one hair tunnel opposite the first peripheral edge, wherein the second peripheral edge is closer to the suction hole than the first peripheral edge is.

7. The vacuum cleaner of claim 6, wherein the second sweeper is formed in a group bristle shape with a predetermined width.

8. The vacuum cleaner of claim 6, wherein the first and second sweepers are formed in a comb-tooth shape.

9. The vacuum cleaner of claim 8, wherein an interval between adjacent comb teeth of the second sweeper is less than an interval between adjacent comb teeth of the first sweeper.

10. The vacuum cleaner of claim 9, wherein comb teeth of the first sweeper are longer than comb teeth of the second sweeper.

11. The vacuum cleaner of claim 10, wherein some of the comb teeth of the first sweeper comprise a support member that reduces an operation resistance by the first sweeper.

* * * * *